US010557610B1

(12) United States Patent
Lim et al.

(10) Patent No.: US 10,557,610 B1
(45) Date of Patent: Feb. 11, 2020

(54) LIGHTING APPARATUS FOR VEHICLE

(71) Applicants: Hyundai Motor Company, Seoul (KR); Kia Motors Corporation, Seoul (KR)

(72) Inventors: Jung Wook Lim, Seoul (KR); Seung Hyeok Chang, Suwon-si (KR); Ki Hong Lee, Seoul (KR); Byoung Suk Ahn, Gwacheon-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/171,650

(22) Filed: Oct. 26, 2018

(30) Foreign Application Priority Data

Aug. 13, 2018 (KR) ..... 10-2018-0094483

(51) Int. Cl.

| | |
|---|---|
| ***F21S 41/32*** | (2018.01) |
| ***F21S 41/64*** | (2018.01) |
| ***F21S 41/33*** | (2018.01) |
| *F21S 41/148* | (2018.01) |

(52) U.S. Cl.
CPC ..... *F21S 41/645* (2018.01); *F21S 41/32* (2018.01); *F21S 41/337* (2018.01); *F21S 41/148* (2018.01)

(58) Field of Classification Search
CPC ..... F21S 41/645; F21S 41/32; F21S 41/337; F21S 41/148
See application file for complete search history.

(56) References Cited

U.S. PATENT DOCUMENTS

| | | | | |
|---|---|---|---|---|
| 10,359,647 | B2 * | 7/2019 | Vasiliev | G02C 7/101 |
| 2012/0243067 | A1 * | 9/2012 | Baumann | B60R 1/088 359/267 |

FOREIGN PATENT DOCUMENTS

| | | | |
|---|---|---|---|
| JP | H 10-302506 | A | 11/1998 |
| JP | 2015-115276 | A | 6/2015 |
| KR | 10-2015-0071059 | A | 6/2015 |

* cited by examiner

*Primary Examiner* — Donald L Raleigh
(74) *Attorney, Agent, or Firm* — Morgan, Lewis & Bockius LLP

(57) ABSTRACT

A lighting apparatus for a vehicle may include a light source emitting light of a predetermined color; a reflector reflecting the light emitted from the light source to project the light externally, the reflector having a color different from the color of the light emitted from the light source to change the color of the light when the light is reflected; and a light transmittance variable portion positioned between the light source and the reflector such that the light emitted from the light source is incident thereupon prior to the reflector, the light transmittance variable portion being configured to vary in light transmittance.

8 Claims, 4 Drawing Sheets

LIGHTING APPARATUS FOR VEHICLE

CROSS REFERENCE TO RELATED APPLICATION

The present application claims priority to Korean Patent Application No. 10-2018-0094483, filed Aug. 13, 2018, the entire contents of which is incorporated herein for all purposes by this reference.

BACKGROUND OF THE INVENTION

Field of the Invention

The present invention relates to a lighting apparatus for a vehicle, and more particularly, the apparatus emitting light of various colors.

Description of Related Art

In general, a vehicle is provided with lighting apparatuses for allowing a driver to clearly identify an object in a direction of driving during nighttime driving and for informing pedestrians and/or drivers of other vehicles of a driving state of a driver's vehicle. A lamp, also referred to as a headlamp, is a lamp that lights a road ahead of the vehicle.

Such a lamp may be classified into a headlamp, a fog lamp, a turn signal lamp, a brake lamp, and a back up lamp, and the like, and directions of light emission thereof to a road surface are set differently, respectively.

These lamps are low in degree of freedom of light because color of projected light is determined depending on a light source and color of lens. In addition, to emit light of various colors, a light source, a reflecting surface, and a lens for expressing the colors are additionally provided, causing the layout to be complicated and increasing manufacturing costs.

The information disclosed in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a lighting apparatus for a vehicle, wherein the apparatus emits light of various colors without an increase in the complication of the layout and enables the color of the light to be determined according to various driving conditions through color combination.

In various aspects of the present invention, there is provided a lighting apparatus for a vehicle, the apparatus including: a light source emitting light of a predetermined color; a reflector reflecting the light emitted from the light source to project the light externally, the reflector having a color different from the color of the light emitted from the light source to change the color of the light when the light is reflected; and a light transmittance variable portion positioned between the light source and the reflector such that the light emitted from the light source is incident thereupon prior to the reflector, the light transmittance variable portion being configured to vary in light transmittance, wherein when the light transmittance variable portion is set to have a low light transmittance, the light emitted from the light source is reflected off the light transmittance variable portion and thus is projected in the predetermined color thereof, and when the light transmittance variable portion is set to have a high light transmittance, the light emitted from the light source is transmitted through the light transmittance variable portion and reflected by the reflector to be changed in color and thus is projected in a changed color.

The reflector may have a parabolic shape having a curvature, the light source may be positioned at a parabolic focus of the reflector, and the light transmittance variable portion may be integrally coupled to the reflector and have the same curvature as the reflector.

The light transmittance variable portion may be a variable film varying in light transmittance depending on whether electric power is applied thereto.

The apparatus may further include an external lens positioned on a path along which the light emitted from the light source is reflected by the reflector and projected, the external lens having a color different from the color of the light emitted from the light source and the color of the reflector.

The reflector may have multiple curved surfaces, the multiple curved surface being configured such that all or some of the curved surfaces have different colors.

The light transmittance variable portion may be provided in plural to respectively correspond to the multiple curved surfaces of the reflector, and multiple light transmittance variable parts may be configured to individually vary in light transmittance.

At least two or more light transmittance variable parts may be provided to be positioned between the light source and the reflector, and the multiple light transmittance variable parts may have multiple color lenses of differing colors interposed therebetween.

The multiple light transmittance variable parts and the color lenses may be sequentially stacked on top of each other on the reflector.

The multiple light transmittance variable parts may be configured to individually vary in light transmittance, and varying of the light transmittance is performed such that the light transmittance is varied sequentially in a direction in which the light emitted from the light source travels to the reflector.

According to the lighting apparatus for the vehicle having the above-described configuration, it is possible to realize the externally emitted light of various colors through combination of various colors of light and thus to perform a lighting function according to the driving conditions and improve a lighting design. Additionally, the film-type light transmittance variable portion that varies in light transmittance is configured to be coupled to the reflector, so that it is possible to realize light of various colors without an increase in the complication of the layout and to determine the color of light according to various driving conditions, improving lamp visibility and safety.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
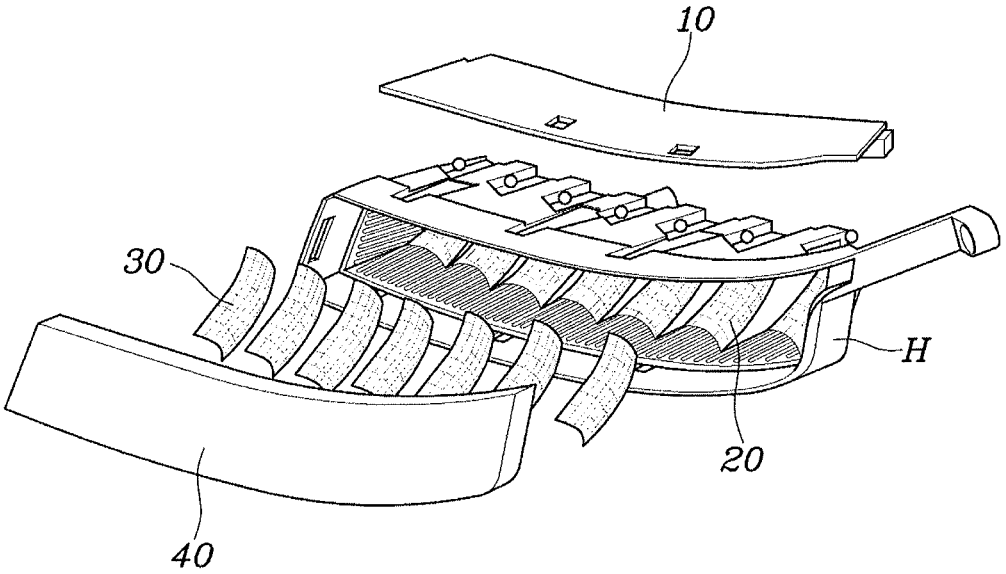
FIG. 1 is a view showing a lighting apparatus for a vehicle according to an exemplary embodiment of the present invention.

It may be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the other hand, the invention(s) is/are intended to cover not only the exemplary embodiments, but also various alternatives, modifications, equivalents and other embodiments, which may be included within the spirit and scope of the invention as defined by the appended claims.

Hereinbelow, a lighting apparatus for a vehicle according to exemplary embodiments of the present invention will be described in detail with reference to the accompanying drawings. Throughout the drawings, the same reference numerals will refer to the same or like parts.

Figure 2:
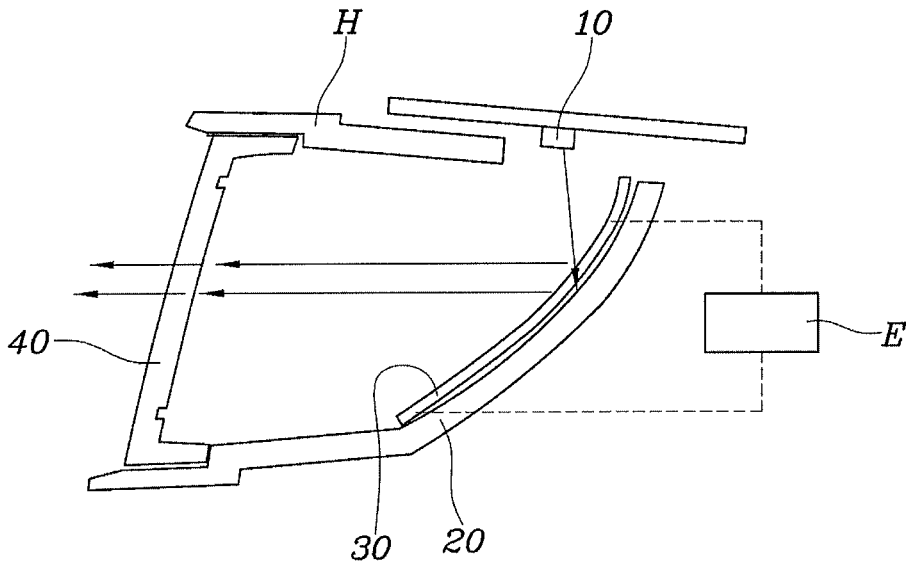
FIG. 2 is a view showing a first of the lighting apparatus for the vehicle shown in FIG. 1.
Figure 3:
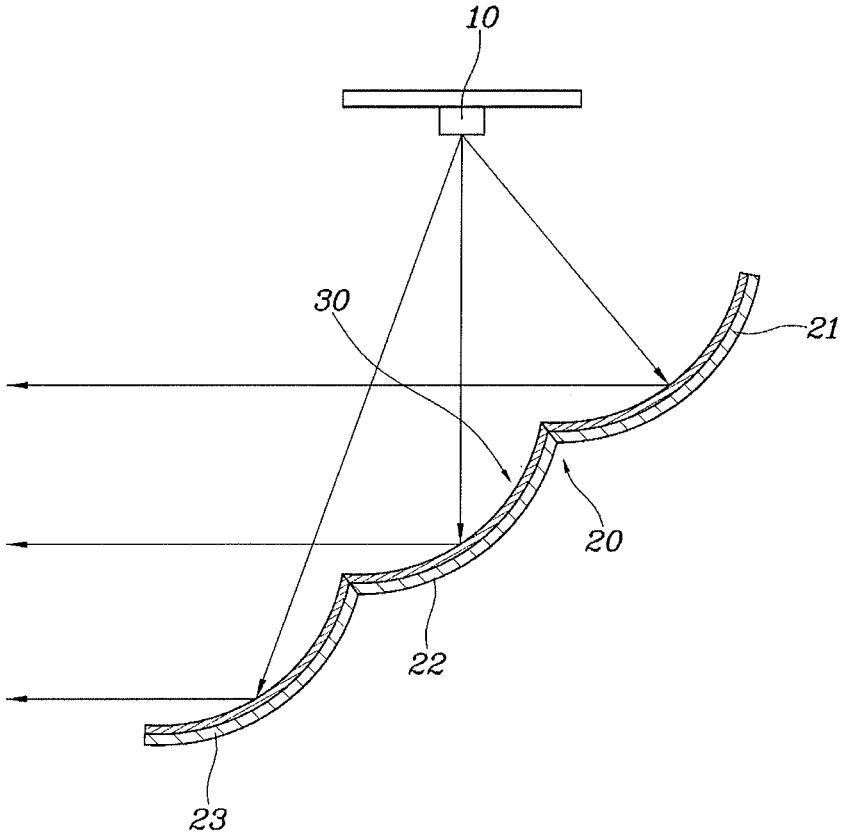
FIG. 3 is a view showing various exemplary embodiments of the lighting apparatus for the vehicle shown in FIG. 1.
Figure 4:
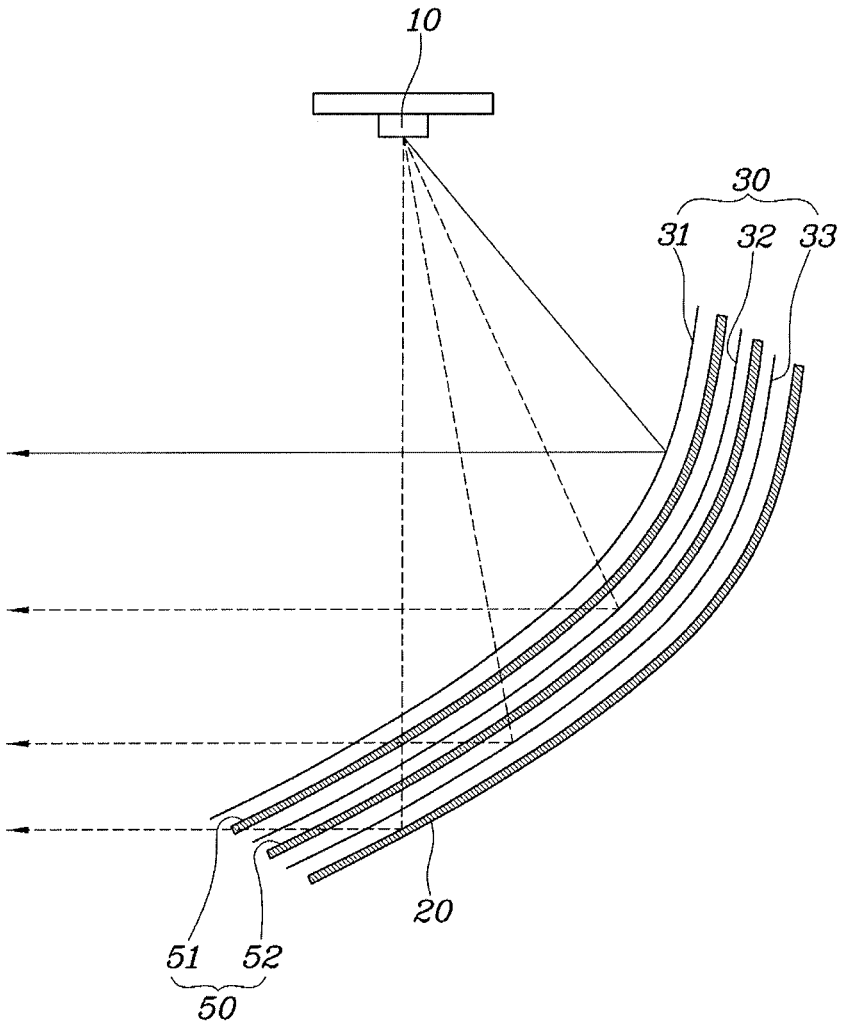
FIG. 4 is a view showing various exemplary embodiments of the lighting apparatus for the vehicle shown in FIG. 1.

FIG. 1 is a view showing a lighting apparatus for a vehicle according to an exemplary embodiment of the present invention, FIG. 2 is a view showing a first of the lighting apparatus for the vehicle shown in FIG. 1, FIG. 3 is a view showing various exemplary embodiments of the lighting apparatus for the vehicle shown in FIG. 1, and FIG. 4 is a view showing various exemplary embodiments of the lighting apparatus for the vehicle shown in FIG. 1.

As shown in FIG. 1 and FIG. 2, a lighting apparatus for a vehicle may include a light source 10 emitting light of a predetermined color; a reflector 20 reflecting the light emitted from the light source 10 to project the light externally, the reflector having a color different from the color of the light emitted from the light source 10 to change the color of the light when the light is reflected; and a light transmittance variable portion 30 positioned between the light source 10 and the reflector 20 such that the light emitted from the light source 10 is incident thereupon prior to the reflector 20, the light transmittance variable portion being configured to vary in light transmittance.

As described above, the present invention includes the light source 10, the reflector 20, and the light transmittance variable portion 30, wherein the light source 10 is an LED, and the reflector 20 reflects the light emitted from the light source to change a traveling path of the light to be projected externally. Herein, the color of the light emitted from the light source 10 and the color of the reflector 20 are different from each other, whereby the color the light emitted from the light source 10 is changed due to complementary color upon reflection by the reflector 20, causing the light emitted externally to be changed in color.

Furthermore, the reflector 20 has a parabolic shape having a curvature, and the light source 10 is positioned at a parabolic focus of the reflector 20, such that the light emitted from the light source 10 is reflected by the reflector 20 and thus travels along a path conforming to the parabolic shape of the reflector 20 to be projected. The parabolic-shaped reflector 20 has the light transmittance variable portion 30 integrally coupled thereto, and the light transmittance variable portion 30 is set to have a low light transmittance, resulting in the light emitted from the light source 10 being reflected to travel along the same path as the reflector 20.

Herein, since the light transmittance variable portion 30 is configured to vary in light transmittance, it is possible to change the color of the light emitted externally. In other words, when the light transmittance variable portion 30 is set to have the low light transmittance, the light emitted from the light source 10 is reflected off the light transmittance variable portion 30 and thus is projected externally in the predetermined color thereof. Conversely, when the light transmittance variable portion 30 is set to have a high light transmittance, the light emitted from the light source 10 is transmitted through the light transmittance variable portion 30 and reflected by the reflector 20 to be changed in color and thus is projected externally in a changed color.

As described above, depending on the light transmittance of the light transmittance variable portion 30, the light emitted from the light source 10 is emitted externally without changing in color, or is emitted externally after changing in color due to the reflector 20. This allows the light emitted externally to be selectively changed in color depending on the light transmittance of the light transmittance variable portion 30. Furthermore, since the light transmittance variable portion 30 is integrally coupled to the reflector 20, the present invention can simplify the configuration for changing the color of light and thus can simplify the layout.

The present invention described above will be described in detail. The light transmittance variable portion 30 may be a light transmittance variable film varying in light transmittance depending on whether electric power is applied thereto.

The light transmittance variable portion 30 may be various light transmittance variable films such as a suspended particle device film, a polymer dispersed liquid crystal film, a cholesteric liquid crystal film, an electrochromic film, an electronic polarizer film, etc. The light transmittance of the light transmittance variable portion 30 may be varied depending on whether electric power is applied thereto, which is determined by control of a lamp controller E.

In other words, when electric power is not applied, the light transmittance variable portion 30 reflects the incident light because the light transmittance decreases, whereby the light emitted from the light source 10 is reflected off the light transmittance variable portion 30 and thus is emitted externally in the predetermined color thereof. Conversely, when electric power is applied to the light transmittance variable portion 30, the light transmittance variable portion 30 is switched to a transparent state to increase the light transmittance, transmitting the incident light. Thereafter, the light transmitted through the light transmittance variable portion 30 is incident upon the reflector 20 to be changed in color by the reflector 20, and thus is emitted externally in the changed color.

The light transmittance of the light transmittance variable portion depending on whether electric power is applied thereto may be set opposite to the above example. Accordingly, depending on the amount of electric power applied to the light transmittance variable portion 30, some light may be reflected and some light may be transmitted, variously changing the color of the light emitted externally.

Meanwhile, as shown in FIG. 1 and FIG. 2, the present invention may further include an external lens 40 positioned on a path along which the light emitted from the light source 10 is reflected by the reflector 20 and projected, the external lens having a color different from the color of the light emitted from the light source 10 and the color of the reflector 20.

The external lens 40 is provided at a position where the light is finally emitted externally and is assembled to a lamp housing H. Since the external lens 40 has the color different from the color of the light emitted from the light source 10 and the color of the reflector 20, this causes the light finally emitted externally to be changed in color.

For example, it is assumed that the color of the light emitted from the light source 10 is a BLUE color, the color of the reflector 20 is a GREEN color, and the color of the external lens 40 is a RED color. When the light transmittance variable portion 30 is set to have the low light transmittance, the light emitted from the light source 10 is reflected off the light transmittance variable portion 30, resulting in light of MAGENTA color to be emitted externally through the external lens 40, the MAGENTA color resulting from a combination of the BLUE color of the light emitted from the light source 10 and the RED color of the external lens 40.

On the other hand, when the light transmittance variable portion 30 is set to have the high light transmittance, the light emitted from the light source 10 is transmitted through the light transmittance variable portion 30 and reflected by the reflector 20, resulting in light of WHITE color to be emitted externally through the external lens 40, the white color resulting from a combination of the BLUE color of the light emitted from the light source 10, the GREEN color of the reflector 20, and the RED color of the external lens 40.

As described above, through the color combination of the light emitted from the light source 10, the color of the reflector 20, and the color of the external lens 40, it is possible to enable light of various colors to be selectively emitted externally due to the complementary color.

As various exemplary embodiments of the light apparatus for the vehicle, and as shown in FIG. 3, the reflector 20 may have multiple curved surfaces. The multiple curved surfaces may be configured such that all or some of the curved surfaces have different colors.

Accordingly, since the reflector 20 has the multiple curved surfaces and the multiple curved surfaces have different colors, this allows the light emitted from the light source 10 to be incident upon the multiple curved surfaces such that the light finally emitted externally has partially different colors.

As an example, and as shown in FIG. 3, it is assumed that the curved surfaces of the reflector 20 include a first curved surface 21, a second curved surface 22, and a third curved surface 23, the first and third curved surfaces 21 and 23 having a CYAN color, the second curved surface 22 having the GREEN color. Herein, when the color of the light emitted from the light source 10 is the RED color, the light incident upon the first and third curved surfaces 21 and 23 may be changed in color to the WHITE color while the light incident upon the second curved surface 22 may be changed in color to a YELLOW color.

Additionally, when the light transmittance variable portion 30 is set to have the low light transmittance, the light emitted from the light source 10 may be reflected off the light transmittance variable portion 30 and thus be emitted externally in the RED color thereof.

Meanwhile, the light transmittance variable portion 30 may be provided in plural to respectively correspond to the multiple curved surfaces of the reflector 20, and multiple light transmittance variable parts 30 are configured to individually vary in light transmittance. Accordingly, the light transmittance variable parts 30 respectively correspond to the multiple curved surfaces of the reflector 20, partially varying in light transmittance for each curved surface of the reflector 20.

Referring to the example according to FIG. 3, among the light transmittance variable parts 30 corresponding to the first curved surface 21, the second curved surface 22, and the third curved surface 23 that form the reflector 20, when the light transmittance variable parts 30 corresponding to the first and third curved surfaces 21 and 23 are set to have the low light transmittance while the light transmittance variable portion 30 corresponding to the second curved surface 22 is set to have the high light transmittance, the light reflected off the light transmittance variable parts 30 corresponding to the first and third curved surfaces 21 and 23 may be emitted externally in the RED color, and the light transmitted through the light transmittance variable portion 30 corresponding to the second curved surface 22 and reflected off the second curved surface 22 may be emitted externally in the YELLOW color. Additionally, when the light transmittance of the light transmittance variable portion 30 corresponding to the second curved surface 22 is set to be repeatedly switched from the high light transmittance to the low light transmittance, the light is caused to be reflected off the second curved surface 22 and emitted externally to be repeatedly changed in color from the YELLOW color to the RED color. This may make it possible to realize turn signal lighting.

As described above, through the configuration in which the reflector 20 has the multiple curved surfaces, and the light transmittance variable parts 30 respectively correspond to the curved surfaces, it is possible to partially change the color of the light emitted externally depending on the color of the multiple curved surfaces of the reflector 20. Additionally, the light transmittance variable parts 30 selectively vary in light transmittance, such that the light transmittance of the light transmittance variable portion 30 corresponding to a predetermined curved surface among the multiple curved surfaces is varied, facilitating light of perceptible color corresponding to driving conditions of a vehicle to be emitted externally.

On the other hand, as various exemplary embodiments of the lighting apparatus for the vehicle, and as shown in FIG. 4, at least two or more light transmittance variable parts 30 may be provided to be positioned between the light source 10 and the reflector 20. The multiple light transmittance variable parts 30 may have multiple color lenses 50 of differing colors interposed therebetween.

Accordingly, the color lenses 50 of differing colors are located between the multiple light transmittance variable parts 30, whereby it is possible to selectively vary the light transmittance of the multiple light transmittance variable parts 30 and thus to change the color of the light transmitted through the color lenses 50.

To the present end, the multiple light transmittance variable parts 30 and the color lenses 50 may be sequentially stacked on top of each other on the reflector 20. In other words, as shown in FIG. 4, the color lenses 50 of differing colors may be located between the multiple light transmittance variable parts 30. The color lenses 50 and the light transmittance variable parts 30 may be sequentially stacked on top of each other in a sequence of a light transmittance variable portion 30 and a color lens 50 in a direction in which the light emitted from the light source 10 travels to the reflector 20. Accordingly, the color lenses 50 are located between the light transmittance variable parts 30 and secured to the reflector 20.

Furthermore, the multiple light transmittance variable parts 30 may be configured to individually vary in light transmittance. Varying of the light transmittance is performed such that the light transmittance is varied sequentially in the direction in which the light emitted from the light source 10 travels to the reflector 20, resulting in the color of the light being sequentially changed by the color lenses 50.

As an example, and as shown in FIG. 4, the color of the light emitted from the light source 10 may be an A color, the color lens 50 may be constituted by a B-color lens 51 and a C-color lens 52, and the color of the reflector 20 may be a D color, while the light transmittance variable portion 30 may be constituted by a first variable portion 31, a second variable portion 32, and a third variable portion 33. Herein, the light transmittance variable parts 30 and the color lenses 50 may be stacked on top of each other in a sequence of the first variable portion 31, the B-color lens 51, the second variable portion 32, the C-color lens 52, the third variable portion 33, and the reflector 20.

Thus, when the first variable portion 31 is set to have the high light transmittance, the light emitted from the light source 10 is caused to be reflected off the first variable portion 31 and thus be emitted externally in the A the color.

On the other hand, when the first variable portion 31 is set to have the high light transmittance and the second variable portion 32 is set to have the low light transmittance, the light emitted from the light source 10 is caused to be changed in color while being transmitted through the first variable portion 31 and the B-color lens 51 and then reflected off the second variable portion 32, whereby the light is emitted externally in the A+B color.

On the other hand, when the first variable portion 31 and the second variable portion 32 are set to have the high light transmittance while the third variable portion 33 is set to have the low light transmittance, the light emitted from the light source 10 is caused to be changed in color while being transmitted through the first variable portion 31, the B-color lens 51, the second variable portion 32, and the C-color lens 52 and then reflected off the third variable portion 33, whereby the light is emitted externally in the A+B+C color.

On the other hand, when the first variable portion 31, the second variable portion 32, and the third variable portion 33 are set to have the high light transmittance, the light emitted from the light source 10 is caused to be changed in color while being transmitted through the first variable portion 31, the B-color lens 51, the second variable portion 32, the C-color lens 52, and the third variable portion 33 and then reflected by the reflector 20, whereby the light is emitted externally in the A+B+C+D color.

As described above, through the configuration in which the multiple light transmittance variable parts 30 and the color lenses 50 are sequentially stacked on top of each other on the reflector 20 and the multiple light transmittance variable parts 30 selectively vary in light transmittance depending on the color of the light to be finally emitted externally, it is possible to enable light of various colors to be emitted externally through color combination of light.

According to the lighting apparatus for the vehicle having the above-described configuration, it is possible to realize the externally emitted light of various colors through combination of various colors of light and thus to perform a lighting function according to the driving conditions and improve a lighting design. Additionally, the film-type light transmittance variable portion 30 that varies in light transmittance is configured to be coupled to the reflector 20, so that it is possible to realize light of various colors without an increase in the complication of the layout and to determine the color of light according to various driving conditions, improving lamp visibility and safety.

For convenience in explanation and accurate definition in the appended claims, the terms "upper", "lower", "inner", "outer", "up", "down", "upper", "lower", "upwards", "downwards", "front", "rear", "back", "inside", "outside", "inwardly", "outwardly", "internal", "external", "inner", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A lighting apparatus for a vehicle, the apparatus comprising:

a light source emitting light of a first predetermined color;

a reflector reflecting the light emitted from the light source to project the light externally, the reflector configured to change the first predetermined color of the light of the light source when the light of the light source is reflected by the reflector; and a light transmittance variable portion disposed between the light source and the reflector such that the light emitted from the light source is incident thereupon prior to the reflector, the light transmittance variable portion being configured to vary in light transmittance, wherein, when the light transmittance variable portion is set to have a light transmittance lower than a predetermined light transmittance, the light emitted from the light source is reflected off the light transmittance variable portion and thus is projected in a second predetermined color, wherein when the light transmittance variable portion is set to have a light transmittance higher than the predetermined light transmittance, the light emitted from the light source is transmitted through the light transmittance variable portion and reflected by the reflector to be changed in color and thus is projected in a changed color different from the second predetermined color, wherein the reflector has a parabolic shape having a curvature, wherein the light source is disposed at a parabolic focus of the reflector, and wherein the light transmittance variable portion is integrally coupled to the reflector and has a same curvature as the curvature of the reflector.

2. The apparatus of claim 1, wherein the light transmittance variable portion is a variable film varying in the light transmittance depending on when electric power is applied to the light transmittance variable portion.

3. The apparatus of claim 1, further including:

an external lens disposed on a path along which the light emitted from the light source is reflected by the reflector and projected, the external lens having a color different from the first predetermined color of the light emitted from the light source and the color of the reflector.

4. The apparatus of claim 1, wherein the reflector has a plurality of curved surfaces along a length of the reflector, and wherein the plurality of curved surfaces of the reflector is configured such that at least one of the curved surfaces of the reflector has a different color from remaining curved surfaces among the plurality of curved surface in the reflector.

5. The apparatus of claim 4, wherein the light transmittance variable portion is provided in plural to form a plurality of light transmittance variable portions to respectively correspond to the plurality of curved surfaces of the reflector, and wherein the plurality of light transmittance variable portions is configured to individually vary in light transmittance.

6. The apparatus of claim 1, wherein at least two light transmittance variable portions are provided to be disposed between the light source and the reflector, and wherein a plurality of color lenses of differing colors is interposed between the at least two light transmittance variable portions.

7. The apparatus of claim 6, wherein the at least two light transmittance variable portions and the color lenses are sequentially stacked on top of each other on the reflector in a direction of light which is incident from the reflector.

8. The apparatus of claim 6, wherein the at least two light transmittance variable portions are configured to individually vary in light transmittance, and varying of the light transmittance thereof is performed such that the light transmittance is varied sequentially in a direction in which the light emitted from the light source travels to the reflector.

* * * * *